US005975595A

United States Patent [19]

Lorenzo

[11] Patent Number: 5,975,595

[45] Date of Patent: Nov. 2, 1999

[54] PROTECTOR FOR CONTAINERS AND SECURITY ELEMENT

[76] Inventor: Lorenzo Lorenzo, 12460 SW. 41 St., Miami, Fla. 33175

[21] Appl. No.: 09/216,617

[22] Filed: Dec. 18, 1998

Related U.S. Application Data

[63] Continuation-in-part of application No. 08/924,525, Sep. 5, 1997.

[51] Int. Cl.[6] ..... E05B 39/02

[52] U.S. Cl. ..... 292/205; 292/DIG. 2; 292/DIG. 32; 70/56; 70/158; 70/DIG. 57

[58] Field of Search ..... 292/307 R, 307 B, 292/DIG. 32, 317, 205, DIG. 2; 70/54, 55, 56, DIG. 57, DIG. 56, 158, 159, 160, 161

[56] References Cited

U.S. PATENT DOCUMENTS

| | | | |
|---|---|---|---|
| 256,902 | 4/1882 | Kirk | 70/56 |
| 1,673,329 | 6/1928 | Hart | 70/9 |
| 4,033,156 | 7/1977 | Cottingham | 70/56 |
| 4,566,296 | 1/1986 | Kochakis | 70/56 |
| 4,852,920 | 8/1989 | DeForrest, Sr. | 292/205 |
| 4,885,921 | 12/1989 | Sharav | 70/159 |
| 5,118,149 | 6/1992 | Emmons | 292/327 |
| 5,168,258 | 12/1992 | Radke | 340/542 |
| 5,275,028 | 1/1994 | Giarrante | 70/56 |
| 5,553,904 | 9/1996 | Lorenzo | 292/307 |
| 5,737,946 | 4/1998 | Sole et al. | 70/54 |
| 5,743,118 | 4/1998 | Anderson | 70/56 |
| 5,878,604 | 3/1999 | Stone et al. | 70/56 |

*Primary Examiner*—Darnell M. Boucher
*Assistant Examiner*—Clifford B Vaterlaus
*Attorney, Agent, or Firm*—J. Sanchelima

[57] ABSTRACT

A protector device for hardware latch members used in conventional containers and trailers to secure in place the pivoting locking bar members. The device includes a housing having a substantially rectangular cross-section defined by side walls, a top wall and a bottom wall. Hingedly mounted tabs extending outwardly from the inner edge of the side walls are foldable within the housing and secured on the hardware latch members of the door being protected. The distal ends of the latch members include openings though which a conventional protective seal member is passed. Upper and lower concave members join the walls' outer edges and they are separated defining aperture inbetween. In front of the aperture a convex wall is mounted to the outer edges of the side walls and cutouts on the upper and lower walls permit a protective seal member through. The latch members are completely covered and protected. Removal of the hardware latch members requires damaging the protector device and thus signaling tampering to anyone inspecting the containers or trailers.

4 Claims, 1 Drawing Sheet

PROTECTOR FOR CONTAINERS AND SECURITY ELEMENT

OTHER RELATED APPLICATIONS

The present application is a continuation-in-part of pending of U.S. patent application Ser. No. 08/924,525, filed on Sep. 5, 1997, which is hereby incorporated by reference.

BACKGROUND OF THE INVENTION

1. Field of the Invention

The present invention relates to a protector device, and more particularly, to the type that protects the doors of shipping containers and trailers from tampering.

2. Description of the Related Art

The closest reference known to applicant corresponds to a Container Hasp Protector patented by Robert F. Emmons in 1992 under U.S. Pat. No. 5,118,149. Emmons' device, however, does not completely protect hasp members 20 and 22 since a trespasser can readily reach bolts 18. The same can be said for the embodiments in FIGS. 5 and 6 which make it more difficult for a user to snap off the head of pin 47. The present invention provides access to the intended addressee to snap security pin member (47 in Emmons) which is typically used with containers. The claimed invention, however, includes concave walls that permit access while at the same time protect the hasp or latch members. This is an important advantage over Emmons.

Another protective mechanism to secure the contents of containers and trailers with characteristics similar to the present invention correspond U.S. Pat. No. 5,553,904 issued on Sep. 10, 1996 to Protecting Seal for Shipping Containers and Trailers. The patented invention provides for the protection of the rotating bar preventing a wrongdoer from removing the pin of the locking pivoting bar housing and leaving the conventional seal intact. The present invention protects the hardware secured by the protecting seal since this hardware is also susceptible to being carefully removed in order to not violate the seal. This hardware is typically implemented with pivotally mounted latch members $L_1$ and $L_2$.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that protects and/or deters tampering with the locking mechanisms of container and trailer doors. At the same time, the present invention allows a user to have ready access to the protective seal for cutting it when the container or trailer arrives to its intended destination.

It is another object of this invention to provide a device that conspicuously shows when the hardware protected by protective seals has been tampered with, thereby ascertaining the parties responsible for the trespass.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
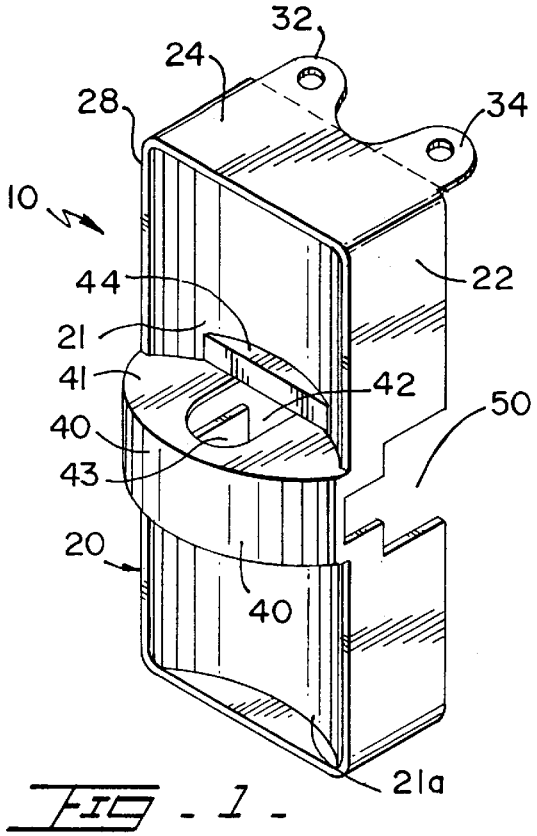
FIG. 1 represents an isometric view of the protector device subject of the present application.
Figure 2:
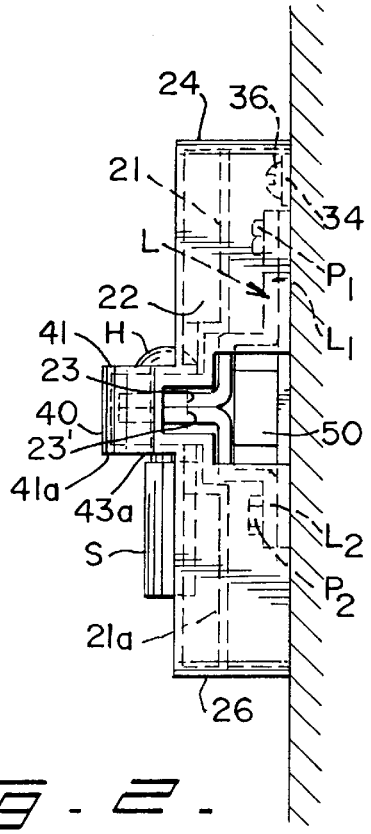
FIG. 2 shows a side elevational view of the device shown in the previous figure protecting the conventional latch hardware found in the typical container or trailer door.
Figure 3:
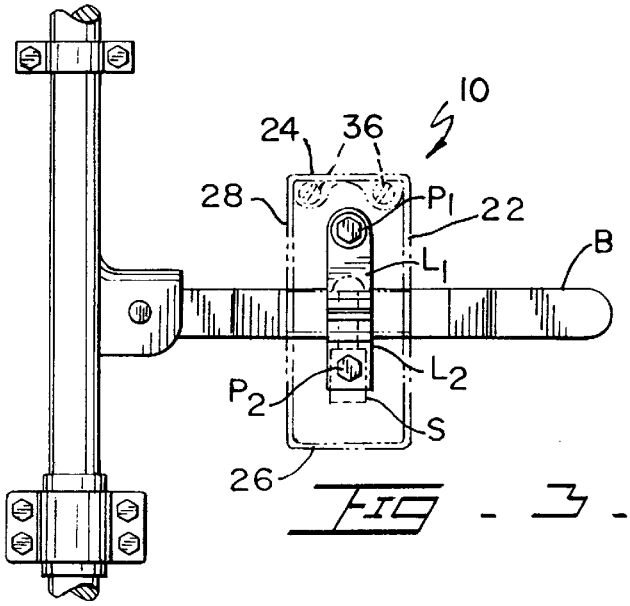
FIG. 3 is a partial illustration of the locking assembly used in containers and trailers.

Referring now to the drawings, where the present invention is generally referred to with numeral 10, it can be observed in FIG. 1, that it basically includes housing 20 with side walls 22 and 28, top wall 24 and bottom wall 26, defining a rectangle in cross-section, in the preferred embodiment. Upper and lower concave walls 21 and 21*a* are mounted to the connecting common outer edge of walls 22; 24; 26 and 28 defining a space within housing 20 that substantially houses hardware latch L entirely, as best seen in FIG. 2. The separation between upper and lower concave walls 21 and 21*a* define aperture 42. Latch L includes members $L_1$ and $L_2$ that are pivotally mounted to the door being protected by pivoting pin members $P_1$ and $P_2$ and are adapted to trap or embrace pivoting locking bar B. The distal ends of members $L_1$ and $L_2$ include each cooperativing through openings 23 and 23' that, when they coincide, permit protective seal member S to pass through.

Convex guard or wall 40 cooperatively houses the distal ends of latch members $L_1$ and $L_2$ that include each through openings 23 and 23' through which seal member S is inserted and one of the two headed terminations H locked. Convex wall 40 includes upper and lower walls 41 and 41*a*, respectively, with cut outs 43 and 43*a*. Convex wall 40 extends from side wall 22 to side wall 28. Seal S is suspended in front of concave upper and lower walls 21 and 21*a* permitting an inspector to readily ascertain that the container or opening being protected has not been violated. Curved or convex wall 40 also includes strengthening step member 44 to enhance the structural integrity of device 10 and simultaneous provide a support to headed end H of seal member S. In this manner, part of the body or shank of seal member S is exposed so that it can readily be clipped off by the intended receiver of the container. The concavity of walls 21 and 21*a* is such that it cooperates with conventional cutters to permit the latter to reach in a position to cut seal member S. In this manner, critical latch members L1 and L2 are protected by upper and lower walls 21 and 21*a* while maximum exposure is provided to element S for its ready removal.

Housing 20 includes tabs 32 and 34 that are integrally built as an extension of wall 24 and are hingedly mounted thereon, as seen in FIG. 1. In FIG. 2, it can be seen how tab 34 (and also tab 32 behind it) is bent and fastening members 36 secure them against the surface of the door being protected. Housing 20 covers seal member S which is inserted through the openings of hardware latch members $L_1$ and $L_2$ thus preventing the removal of housing 20 without breaking seal member S. In this manner, the hardware, especially latch members $L_1$ and $L_2$, cannot be tampered with unless protector 10 is destroyed or visibly damaged.

Walls 22 and 28 have similar cut-outs 50 that trap pivoting locking bar B. Cut-out 50 is best seen in FIG. 1, for one of the preferred embodiments.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protective device, comprising:

A) a door hingedly mounted to a container having an opening, said door being cooperatively mounted to open and close said opening and further including a pivoting bar mounted to said door;

B) a latch assembly including first and second pivoting members mounted to said container substantially adjacent to said opening and said first and second pivoting members include free distal ends that extend perpendicularly with respect to said first and second pivoting members and each of said free distal ends includes a cooperating through opening and said first and second pivoting members include a conforming cooperating shape to embracingly receive said pivoting bar when said through openings coincide;

C) housing means for covering and protecting said first and second pivoting members having a frame with a top wall, a bottom wall and two side walls with common outer and inner edges, and upper and lower concave walls joining said side walls from said common outer edge and defining an aperture inbetween said upper and lower concave walls, and further including a convex wall joining said side walls from said common outer edge and said convex wall being positioned between said upper and lower concave walls in front of said aperture, said convex wall includes upper and lower walls having each a cutout, said housing means further including inwardly bendable tabs extending from said inner edge;

D) fastening means for securing said tabs to said door; and

E) a protective seal member having two headed ends, and one of said headed ends being fixed and the other headed end being locked after insertion of said protective seal member through said cutouts and through openings so that said headed ends are exposed and ready to be clipped off so that any tempering breaking said protective seal member is readily noticeable.

2. The protective device set forth in claim 1 wherein said tabs are hingedly mounted to said housing means and foldable within said housing means so that said first and second pivoting members are completely covered and protected by said housing means.

3. The protective device set forth in claim 2 wherein said convex wall further includes a step cooperatively positioned on said upper concave wall adjacent to said aperture so that a protective seal member inserted through said cutouts is exposed.

4. The protecting device set forth in claim 3 wherein said side walls include cut outs that permit said pivoting locking bar member through.

* * * * *